US009099225B2

(12) United States Patent
Pagliuca

(10) Patent No.: US 9,099,225 B2
(45) Date of Patent: Aug. 4, 2015

(54) PRIMARY WIRE FOR MARINE AND SUB-SEA CABLE

(75) Inventor: Antonio Pagliuca, Witney (GB)

(73) Assignee: Tyco Electronics UK Ltd, Swindon Wiltshire (GB)

( * ) Notice: Subject to any disclaimer, the term of this patent is extended or adjusted under 35 U.S.C. 154(b) by 296 days.

(21) Appl. No.: 13/639,702

(22) PCT Filed: Apr. 4, 2011

(86) PCT No.: PCT/EP2011/055174

§ 371 (c)(1), (2), (4) Date: Oct. 5, 2012

(87) PCT Pub. No.: WO2011/124543

PCT Pub. Date: Oct. 13, 2011

(65) Prior Publication Data

US 2013/0020107 A1 Jan. 24, 2013

(30) Foreign Application Priority Data

Apr. 7, 2010 (GB) ..... 1005777.6

(51) Int. Cl.
*H01B 7/00* (2006.01)
*H01B 3/44* (2006.01)
(Continued)

(52) U.S. Cl.
CPC ..... *H01B 3/441* (2013.01); *H01B 3/445* (2013.01); *H01B 7/0216* (2013.01); *H01B 7/14* (2013.01); *Y10T 29/49117* (2015.01)

(58) Field of Classification Search
CPC ..... H01B 3/00; H01B 3/303; H01B 3/305; H01B 3/306; H01B 3/308; H01B 3/40; H01B 3/427; H01B 3/44; H01B 7/00; H01B 7/02; H01B 7/0208; H01B 7/0216; H01B 7/0275; H01B 7/0291; H01B 7/18; H01B 7/1835; H01B 7/1875; H01B 7/28; H01B 7/29; H01B 7/292; H01B 9/00–9/11; H01B 12/00; H01B 12/04
USPC ..... 174/110 R, 110 A–110 PM, 120 R, 174/120 SR, 120 AR, 121 R, 121 AR, 121 SR
See application file for complete search history.

(56) References Cited

U.S. PATENT DOCUMENTS 3,269,862 A * 8/1966 Lanza et al. ..... 428/383
3,650,827 A * 3/1972 Brown et al. ..... 428/383
(Continued)

FOREIGN PATENT DOCUMENTS

WO WO 00/17889 A * 3/2000 ..... H01B 3/44

OTHER PUBLICATIONS

International Preliminary Report on Patentability, issued by The International Bureau of WIPO, Geneva, Switzerland, dated Oct. 9, 2012, for related International Application No. PCT/EP2011/055174; 4 pages.
(Continued)

*Primary Examiner* — William H Mayo, III
(74) *Attorney, Agent, or Firm* — Faegre Baker Daniels LLP

(57) ABSTRACT

Primary wire for marine or undersea cable comprises a conducting core (10), typically a multifilament core of copper, and an insulating sheath comprising an insulating inner layer (12) having a thickness of 0.35 to 1.0 mm, preferably 0.5 to 0.75 mm, and an outer protective layer (14) of polyvinylidene fluoride having a thickness of 0.15 to 0.3 mm, at least the outer layer being radiation crosslinked. The inner and outer layers are preferably crosslinked together using electron beam radiation. The combination of the inner and outer layers of the sheath enables marine and subsea cables and the like to be made with smaller diameters, without loss of capacity or electrical properties and with an increase in overall performance such as temperature range and mechanical properties.

14 Claims, 2 Drawing Sheets

(51) Int. Cl.
*H01B 7/02* (2006.01)
*H01B 7/14* (2006.01)

(56) References Cited

U.S. PATENT DOCUMENTS 5,059,483 A * 10/1991 Lunk et al. ..... 428/383
5,209,987 A * 5/1993 Penneck et al. ..... 428/610
5,358,786 A * 10/1994 Ishikawa et al. ..... 428/380
5,426,264 A * 6/1995 Livingston et al. ..... 174/102 R
5,521,009 A * 5/1996 Ishikawa et al. ..... 428/375
6,017,626 A * 1/2000 Hildreth ..... 428/373
6,207,277 B1 * 3/2001 Shieh ..... 428/375
6,359,230 B1 * 3/2002 Hildreth ..... 174/110 R
6,753,478 B2 * 6/2004 Rodway et al. ..... 174/120 R

OTHER PUBLICATIONS

International Search Report and Written Opinion issued by the European Patent Office, dated Sep. 19, 2011, for related International Application No. PCT/EP2011/055174; 8 pages.

* cited by examiner

PRIMARY WIRE FOR MARINE AND SUB-SEA CABLE

CROSS REFERENCE TO RELATED APPLICATIONS

This application is a 371 national stage entry of PCT/EP2011/055174, filed Apr. 4, 2011, which claims the benefit of GB 1005777.6, filed Apr. 7, 2010.

BACKGROUND AND SUMMARY

This invention relates to an insulated wire or cable suitable for marine and sub-sea applications.

Because marine and sub-sea cables are exposed to very demanding conditions, sea water being potentially corrosive as well as electrically conductive, with sea currents giving rise to considerable mechanical stresses, they have hitherto been of relatively large diameter, but having relatively low and small temperature ranges and being physically less tough than might be desired.

Undersea cables are known which have an inner sheath of a highly insulating polymer such as polyvinyl chloride (PVC) and an outer covering of an inert polymer, for example a fluorinated polymer such as polytetrafluroethylene (PTFE).

A typical sub-sea tether or marine umbilical cable could contain a number of primary wires consisting of a conductor (typically copper or steel) surrounded by an insulating jacket (typically a thick walled cross linked polyethylene (XLPE) though un-crosslinked PE and polypropylene are sometimes used). These primary wires may then be protected by a armoured jacket consisting of metal wires (typically steel or copper wires) or aramid fibres, surrounded by an outer jacket (typically XLPE).

To provide the necessary electrical resistance and temperature rating a thick walled XLPE primary wire is traditionally used in these off-shore marine applications. The limitations of this design are that the thick walled (2.0 mm and over) primary wire results in a large diameter for the overall cable, and therefore limits the length of cable that can be stored on a single drum; thus in turn limits the length of, for example, a submarine tether cable. These wires are also limited in temperature range and physical attributes.

The present invention provides a primary wire for a marine or undersea cable having a conductive core and an insulating sheath, the sheath having an inner layer of a radiation-crosslinked polyalkene as a primary insulation, with a wall thickness of at least 0.35 mm, and an outer jacket of radiation-cross linked polyvinylidene fluoride (PVdF) having a thickness of at least 0.15 mm.

It has been found, surprisingly, that insulated wires in accordance with the invention can have the high insulation and other electrical characteristics of normal XLPE wires, while having a high temperature range, better mechanical properties such as flexibility and physical toughness and the corrosion resistance required for sub-sea, marine and off-shore applications, while being substantially thinner and lighter than conventional XLPE wires. Marine cables incorporating the wires of the invention are tough and strong, abrasion resistant, resistant to chemical attack and highly flexible, with high electrical insulation and a temperature range from −55 to +150° C. This can be achieved by a synergistic combination of bespoke conductor and dual wall insulation.

Wires in accordance with the invention have particular utility as primary wires for marine or undersea cables. In some embodiments both layers are radiation-cross linked Wires of the invention can be made with a total wall thickness of around 0.8 mm, significantly thinner than conventional PE wires traditionally used in these tether and umbilical cable applications.

Additional advantages of using the wires of the invention, at least in preferred embodiments, for sub-sea cable applications include: a higher temperature range (from −55° C. to +150° C.), high electrical resistance, flexibility, corrosion resistance and physical toughness required for sub-sea, marine and offshore applications. A particular advantage of TE cables made with 44 CD wires is the low dielectric constant of the inner layer providing a lower capacitance and allowing individual wires to be bundled closer together without undesirable capacitive effects (e.g. corona effects).

The radiation crosslinking of the insulating polymers imparts increased resistance to cold flow and renders them non-melting at high temperature.

The cables of the invention may be made with metallic core conductors such as copper or with fibre optic conductors.

BRIEF DESCRIPTION OF THE DRAWINGS

A preferred embodiment of the invention will now be described with reference to the accompanying drawing, in which.

DETAILED DESCRIPTION OF THE DRAWINGS

Figure 1:
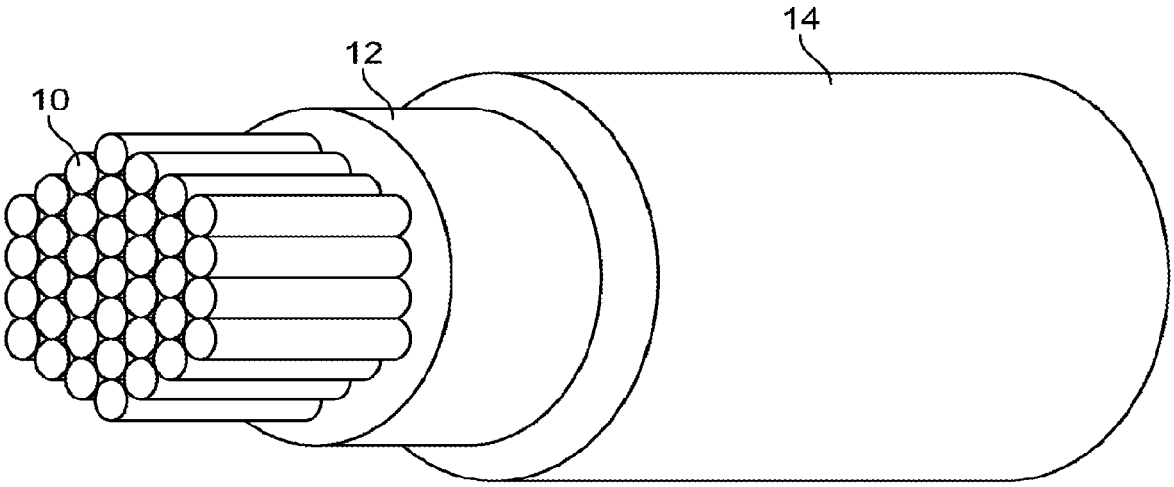
FIG. 1 shows a partially cut away view of a section of a multifilament cable in accordance with the invention.

The cable shown in FIG. 1 comprises a multifilament wire 10 having formed thereon an insulating sheath comprising an inner insulating layer 12 of a radiation-crosslinked polyalkene such as polyethylene, polypropylene and/or polybutylene and an outer layer 14 of radiation crosslinked polyvinylidene fluoride.

The multifilament wire 10 is preferably of copper, but may be of any other suitable conductor such as aluminium, silver or steel. The wire preferably comprises 30 to 70 strands, more preferably at least 50 strands, typically about 61. The individual strands preferably have a diameter of 0.5 to 0.7 mm, suitably about 0.58 mm for a 16 $mm^2$ conductor with close strand proximity. Larger strand sizes tend to impact lower flexibility, with more stress points and interstices between strands, which can adversely affect the thin-walled core. Non-metallic cores such as fibre-optic conductors may also be used. The diameter of the conducting core is preferably 4.80 to 5.10 mm for a 16 $mm^2$ conductor. The outer strands are preferably compacted by up to 10%, preferably 5 to 9%, to give a round, smooth, compact outer-surface without high or low strands and with reduced corona impact. The strands of the wire of the invention can also have a lay length of 6 to 8 times the core diameter, as compared with 12 times diameter in the wires of conventional cables.

The polyalkene of the insulating inner layer 12 is preferably of high-density polyethylene (HDPE) and has a minimum wall thickness of 0.35 mm, and preferably at least 0.5 mm, and a preferred maximum of 1.0 mm, the optimum range being 0.5 to 0.75 mm. The HDPE preferably has a minimum density of 0.95. The HDPE may be blended with ethylene-ethyl acrylate (EEA) copolymer, up to a ratio of HDPE to EEA of at least 3:1. The EEA copolymer preferably has an ethyl acrylate content of 14 to 18%. The polyolefin layer imparts a high degree of electrical insulation while remaining light and flexible.

The PVdF of the outer layer 14 of the sheath is extruded over the inner layer and both layers are crosslinked by electron beam radiation at the same time. The preferred polymer is a newly developed compound based on a unique combination of PVdF homo-polymer and a co-polymer of hexafluoropropene and 1,1'-difluoroethylene (VF2). The thickness of the layer is at least 0.15 mm, the preferred maximum being 0.3 mm. This layer imparts the required toughness, abrasion resistance, flammability resistance, cut-through resistance and resistance to chemicals such as many acids, alkalis, hydrocarbon solvents, fuels, lubricants, water (including sea water) and many missile fuels and oxidants. The inner polyolefin insulation is also resistant to arc tracking under both wet and dry conditions.

Figure 2:
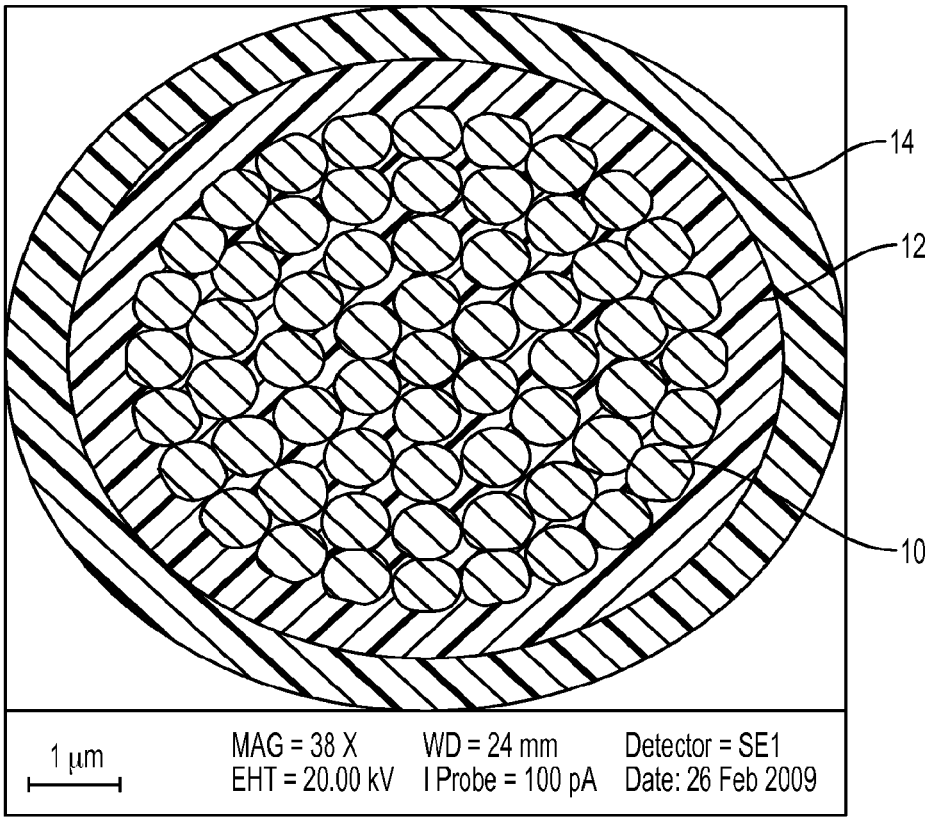
FIG. 2 shows an SEM microtome of a 16 $mm^2$ primary wire in accordance with the invention.

In addition, a new type of copper conductor has been developed for this application which also provided an enhanced performance to help reduce corona and partial discharge via a novel approach. These new conductors were a bespoke design having the parameters of being semi-concentric, flexible, and super smooth with specific compaction levels based on bare copper strands. An example of this optimised innovative conductor is shown in FIG. 2 and can be defined as: 16 $mm^2$ optimised conductor consisting of 61 bare copper strands of 0.582 mm diameter.

This combination of optimised conductor design, combined with electrically clean core material with a low dielectric constant (approaching 3) provides a stable electrical platform to minimise any risk of corona discharge or partial discharge. This allows these primary wires to carry high voltages (3.6/5.4/7.2 Kv; Uo/U/Um) with no partial discharge or corona potential over long lengths (up to 10 km single lengths) whilst retaining their relatively small size, thin wall and low weight advantage.

The dual layer design allows superior properties to be gained as each layer is optimised to provide a particular property. For instance the outer layer provides the necessary abrasion resistance and chemical resistance, and the inner layer provides the necessary electrical insulation and low dielectric constant. A similar overall thickness of just one layer would not provide the same level of performance.

By utilising this dual layer design the diameter of the primary wire can be reduced. This means that either a cable can be constructed with a larger number of primary wires for the same diameter (greater functionality), or the overall diameter of the cable can be reduced. This allows a longer length of cable to be stored on one drum, with the potential benefit that a submarine could operate further away from its mothership.

Figure 3A:
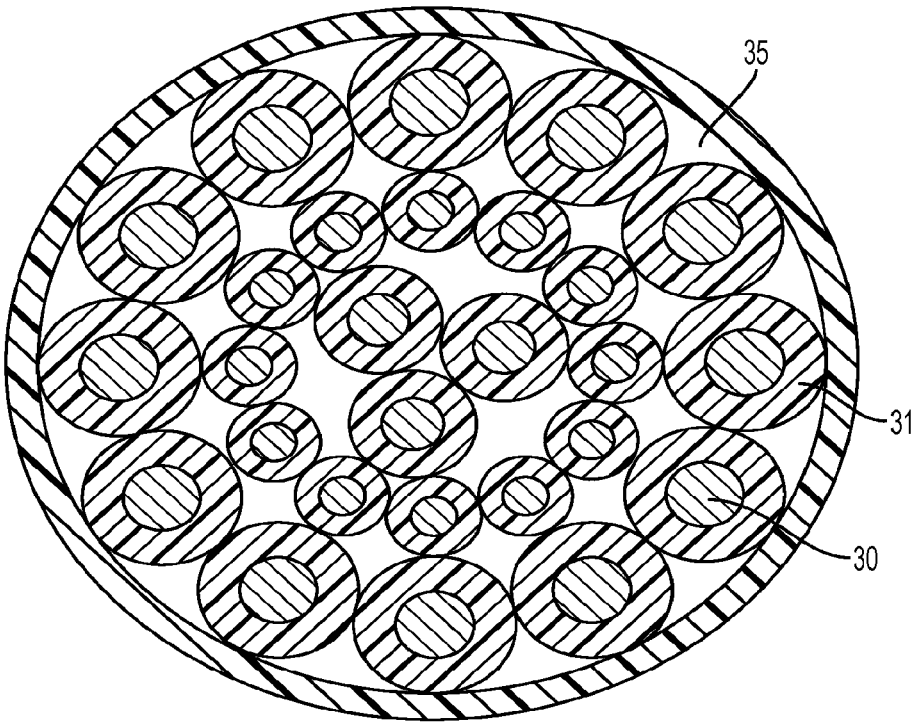
FIGS. 3A and 3B are schematic cross-sectional views comparing the relative dimensions of a conventional undersea cable (3*a*) with those of a cable in accordance with the invention (3B).
Figure 3B:
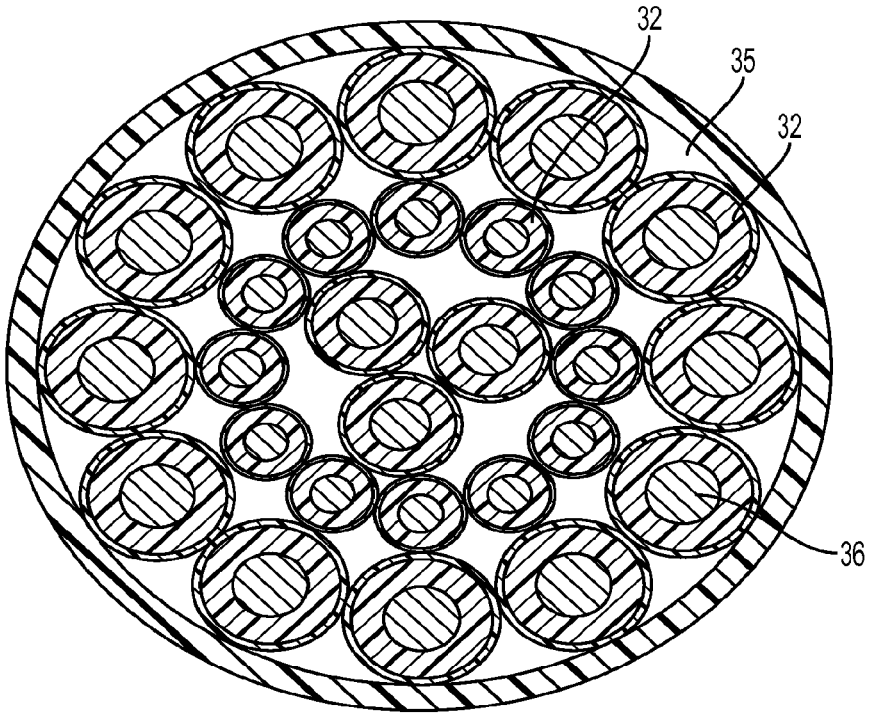

FIG. 3A shows a cross section through an undersea cable, with multiple primary wires each comprising a core 30 and an insulating sheath 31, within an outer covering 35 typically an armoured jacket of steel or copper wires or aramid fibres. FIG. 3B shows a similar arrangement using primary wires in accordance with the invention, with cores 36 and dual sheaths 32 of polyalkene/PVdF. Since these sheaths are considerably thinner than those made of materials conventional in this field, the same number of wires can be accommodated in a cable of smaller diameter, and the wires themselves can be of larger diameter.

New material compounds have been developed that further improve the use of the existing 44 wire platform for marine cable use. The core material design has a lower dielectric constant (3.1) than standard 44 wire core compound (3.8). This allows the cores to be packed closer together, and a new higher voltage rating to be obtained from the same size of cable. The new outer Pi jacket layer was developed that is based on a unique combination of PVdF homo-polymer and PVdF co-polymer that provides good flexibility, toughness and the ability to be extruded without faults over long lengths (10,000 km)

The overall diameter of the wire is preferably 6.5 to 6.9 mm for a 16 $mm^2$ wire the maximum weight preferably not exceeding 200 kg/km. Preferred wires in accordance with the invention can be used at temperatures down to −55° C. or lower and up to +150° C. or higher. The lay length is typically about 6.5 times core diameter.

EXAMPLE

A primary wire for an insulated undersea cable having the construction illustrated in the drawing was made by coating a multifilament copper wire having a diameter of 4.8 to 5.1 mm and cross-sectional area of 16 $mm^2$, made up of 61 strands of diameter 0.582 mm.

First, a primary insulation layer of radiation-crosslinked high density polyalkene was extruded over the core to a thickness of about 0.5 mm. Over this was extruded an outer protective jacket of a blend of polyvinylidene fluoride and HFP/VF2 copolymer, to a minimum thickness of 0.15 mm. The resulting sheath was then cross-linked using electron beam radiation.

The finished wire had a mean diameter of about 6.7 mm and a maximum weight of 175.45 kg/km. Its maximum electrical resistance at 20° C. was 1.210 Ω/km. The voltage rating was up to 3,000 Volts. The electrical properties of the wire are summarized in Table 1 below and compared with those of the multi-purpose SPEC 44 wire of Tyco Electronics, which has a cross-linked polyalkene/PVdF sheath with a wall thickness of 0.19 mm. and voltage ratings of 0.6/1.0 2.5 KV, Uo/U/Um.

TABLE 1

| Electrical Properties | | |
|---|---|---|
| Electrical Properties | Conventional multi-purpose wire (Tyco Electronics SPEC 44) | Wire according to the invention |
| Dielectric constant | 3.80 | 3.05 |
| Power Factor | $8 \times 10^{-4}$ | $3.4 \times 10^{-4}$ |
| Insulation Resistance | 4099 MΩ/km | 4450 MΩ/km |
| AC Capacitance (after 14 days immersion in water) | 0.120 pF | 0.066 pF |
| DC Stability at 3 times rated voltage in salt water (tested @85° C. for 240 hours) | Failed after 6 days | Passed |

The wire was subjected to a series of performance tests for marine and undersea use, as detailed in Table 2 below, meeting all the requirements set out in the right-hand column.

| Test | Test Methods | Test Conditions (see also section 8) | Requirements |
|---|---|---|---|
| R | SAE AS-81044 method 4.7.1 | Insulation construction | |
| R | SAE AS-81044 method 4.7.1 | Finished wire diameter: (mm) | 6.7 mm ± 0.2 mm |
| R | SAE AS-81044 c.3.6.5 with method 4.7.5.9 | Insulation thickness<br>Insulation<br>Pj | 0.5 mm min<br>0.15 mm min |
| R | SAE AS-81044 c.3.6.6 with method 4.7.5.10 | Concentricity (%) - PJ + core | 70% |
| | SAE AS-81044 method 4.7.5.7 | Insulation (primary only): | |
| L | | Tensile strength (MPa) | 17.5 min |
| L | | Elongation (%) | 100 min |
| L | SAE AS-81044 method 4.7.5.2 | Insulation resistance | |
| | | calculated to Mohm/1000 feet at 20 C | 5000 min |
| Q | SAE AS-81044 method 4.7.5.20 | Accelerated ageing 300° C.(±2)/6 h | |
| | | | No cracks<br>No voltage breakdown |
| Q | VG95218pt20A | Voltage Test<br>5 hours immersion in 5% salt solution; | No voltage |
| | IEC60885-1 clause 3 | 3.3 kv for 5 minutes. | breakdown |
| L | SAE AS-81044 method 4.7.5.13 | Shrinkage 150° C./6 h | Less than 0.125 inches in 12 inches |
| Q | SAE AS-81044 method 4.7.5.16 | Cold bend −55° C./4 h | No cracks<br>No voltage breakdown |
| Q | SAE AS-81044 method 4.7.5.18 | Flammability | No flaming particles<br>length burned max 75 mm<br>cease to burn within 30 s |
| Q | VG95218-20c5.4.2.1.1<br>VG95218-2c5.4.2.1.1 (to IEC60885-1c.3) | Ageing in Air Oven (Life Cycle) | No voltage breakdown<br>No cracks |
| Q | SAE AS-81044 c.3.5.2 with method 4.7.1 | Removability of insulation | No insulation shall remain on conductor |
| L | SAE AS-81044 c.3.6.4.2 with method 4.7.5.8.2 | Wrap back test | No cracks |
| Q | EN50305 C6.7 | DC Stability Test<br>(10 days at 85° C. in salt water; 3 times rated voltage | No insulation breakdown |
| R | SAE AS-81044 method 4.7.5.1 | Spark Testing (15 kV rms)<br>(15 kV peak) | No break down |

The invention claimed is:

1. A primary wire for a marine or undersea cable having a conductive core and an insulating sheath, said sheath having an inner layer of a polyalkene as a primary insulation, with a wall thickness of at least 0.35 mm, and an outer jacket of radiation-crosslinked polymer comprising a poly-vinylidene fluoride (PVdF) homopolymer and a copolymer of hexafluoropropylene and 1,1'-difluoroethylene having a thickness of at least 0.15 mm.

2. A wire according to claim 1, wherein the polyalkene inner layer is also radiation crosslinked.

3. A wire according to claim 1, wherein the conductive core comprises a multifilament wire.

4. A wire according to claim 3, wherein the wire comprises 30 to 70 strands.

5. A wire according to claim 3, wherein the lay length of the wire filaments is 6 to 8 times the diameter of the conductive core.

6. A wire according to claim 3, wherein the core is compacted by 5 to 9%.

7. A wire according to claim 1, wherein the core comprises copper.

8. A wire according to claim 1, wherein the core has a diameter of 4.8 to 5.1 mm for a 16 $mm^2$ conductor.

9. A wire according to claim 1, wherein the polyalkene insulating inner layer has a wall thickness of not more than 0.75 mm.

10. A wire according to claim 1, wherein the polyalkene comprises high density polyethylene (HDPE) with a density of at least 0.95.

11. A wire according to claim 10, wherein the high density polyethylene is blended with ethylene-ethyl acrylate copolymer (EEA), at a ratio of HDPE to EEA of at least 3:1.

12. A wire according to claim 1, wherein the outer layer has a thickness of not more than 0.3 mm.

13. A marine or subsea cable comprising a plurality of primary wires according to claim 1, encased within an armoured jacket.

14. A method of making a primary wire according to claim 1, comprising the steps of: extruding over a conductive core an insulating layer of a polyalkene to a thickness of at least 0.35 mm; extruding over the inner layer an outer layer of polyvinylidene fluoride to a thickness of at least 0.15 mm; and crosslinking the inner and outer layers together by means of electron beam radiation.

* * * * *